US005573288A

United States Patent [19]

Raffensperger

[11] Patent Number: 5,573,288

[45] Date of Patent: Nov. 12, 1996

[54] PORTABLE SEAT CUSHION AND STORAGE DEVICE

[75] Inventor: George T. Raffensperger, Boulder, Colo.

[73] Assignee: SIF Products Group Inc., Denver, Colo.

[21] Appl. No.: 358,239

[22] Filed: Dec. 19, 1994

[51] Int. Cl.[6] ..... A47C 7/62

[52] U.S. Cl. ..... 297/188.12; 297/188.13; 297/188.1; 297/DIG. 6

[58] Field of Search ..... 297/118, 129, 297/188.01, 188.08, 188.09, 188.1, 188.12, 188.13, 188.2, DIG. 6; 190/8, 1; 224/155

[56] References Cited

U.S. PATENT DOCUMENTS

| | | | |
|---|---|---|---|
| 2,740,466 | 4/1956 | Priest | 155/133 |
| 2,822,968 | 2/1958 | Jackson | 297/188.2 X |
| 2,865,433 | 12/1958 | Warner | 155/133 |
| 2,909,215 | 10/1959 | Mitchell | 297/188.01 X |
| 3,437,374 | 4/1969 | Bennett | 297/188.01 X |
| 3,763,972 | 10/1973 | Karzmar | 190/8 |
| 4,116,310 | 9/1978 | Shields | 190/42 |
| 4,190,918 | 3/1980 | Harvell | 5/465 |
| 4,450,988 | 5/1984 | Meisel | 224/32 |
| 4,535,878 | 8/1985 | Grahl | 190/8 X |
| 4,556,250 | 12/1985 | Chapman et al. | 297/188.12 |
| 4,690,455 | 9/1987 | Bailey et al | 297/188.07 X |
| 4,708,243 | 11/1987 | Nailon | 206/315.11 |
| 4,783,120 | 11/1988 | Kiechlin | 297/230 |
| 4,799,731 | 1/1989 | Brown | 297/188.12 |
| 4,842,329 | 6/1989 | Owens | 297/188.2 X |
| 4,854,637 | 8/1989 | McCree | 297/188.2 |
| 4,863,003 | 9/1989 | Carter | 190/8 |
| 4,925,064 | 5/1990 | Comora | 224/155 |
| 5,005,679 | 4/1991 | Hjelle | 190/110 |
| 5,016,792 | 5/1991 | Jay | 224/155 |
| 5,050,767 | 9/1991 | Peer | 297/188.12 X |
| 5,120,108 | 6/1992 | Watson et al. | 297/188.2 |

OTHER PUBLICATIONS

The Source for World Cup '94 Catalog, p. 91.
L. L. Bean Catalog, pp. 26 and 49.

*Primary Examiner*—Milton Nelson, Jr.
*Attorney, Agent, or Firm*—Sheridan Ross & McIntosh

[57] ABSTRACT

An article storage device including a storage member having first and second opposing end portions, a padded member, and a mechanism for suspending said storage member directly underneath a seat. The mechanism for suspending includes a connecting member for interconnecting the padded member adjacent the second end portion utilizing a first securing mechanism. The mechanism for suspending includes a mechanism for accommodating a range of seat dimensions. In addition, the connecting member further includes a second securing mechanism for securing the connecting member to a back surface of the storage member to facilitate folding of the device for transport.

16 Claims, 3 Drawing Sheets

PORTABLE SEAT CUSHION AND STORAGE DEVICE

FIELD OF THE INVENTION

The present invention relates to the field of portable seat cushions and storage devices, such as are typically used to transport articles to a spectator event and are then used as a cushion upon which to sit during the event.

BACKGROUND OF THE INVENTION

When attending a spectator event, such as a sporting event, it is often desirable to bring articles to make the event more enjoyable. For example, many people bring food, drinks, rain gear, warm clothes, blankets, sun screen, as well as other articles of convenience. In addition, since many spectator events are held in stadiums where the seats are made from a hard material, such as wood, metal or plastic, it is also sometimes desirable to bring a seat cushion to make the extended sitting period more comfortable.

To satisfy both of these desires, combination seat cushions and storage compartment assemblies have been designed. Such assemblies typically comprise a flat seat cushion interconnected with a storage compartment. In use, the seat cushion is placed on the seat and the storage compartment hangs straight down in front of the seat adjacent the user's legs. Such positioning advantageously positions the storage compartment where it is accessible by the user while the user is sitting on the seat cushion. However, such positioning can also interfere with freedom of movement of the user's legs, thereby reducing the comfort level of the user, and can also interfere with people walking in front of the seat. In addition, if the user stands up off of the seat cushion, the weight of the storage compartment can cause the whole assembly to fall to the ground, thereby soiling the assembly and requiring the assembly to be repositioned onto the seat.

Accordingly, it is an object of the present invention to provide a storage device, having a padded seat cushion, which can be secured to a seat, such as a stadium-type chair or bleacher, and which will not substantially interfere with freedom of movement of a user's legs or interfere with people walking in front of the seat. It is another object to provide such a storage device wherein the device will stay secured to the seat when the user stands up.

SUMMARY OF THE INVENTION

The present invention satisfies one or more of the above-noted objectives by providing an article storage device which allows the user to easily carry and transport many items typically brought to stadium events (e.g., jackets, binoculars, food, beverages, sunglasses, sunscreen, blankets, seat cushions, etc.) in a single pack. Due to the unique design, the storage device easily attaches to, and detaches from, stadium type seating (e.g., both stadium chair and open bench type seating).

The device includes a storage member having first and second opposing end portions (e.g., a top and a bottom), a padded member, and a mechanism for suspending said storage member directly underneath the seat. By virtue of such a device, the storage member is positioned off of the stadium floor to avoid soiling of the device and/or items within the device. Positioning the device directly underneath the seat avoids interference with freedom of movement of the user's legs, avoids interference with people walking in front of the seat, shields the storage member from adverse weather conditions, hides the user's personal items from view of potential thieves, and provides more usable storage capacity than other designs which hang in front of the seat. In addition, articles within the storage compartment and pouches are readily accessible by the user through the openings in the top portion of the storage member and pouches.

In one embodiment, the mechanism for suspending comprises a mechanism for positioning the storage member substantially horizontally adjacent a bottom surface of the seat. That is, the storage member will be flush against the bottom surface of the seat and, therefore, will be horizontal when the seat is horizontal. Such flush attachment essentially fixedly secures the storage member to the bottom of the seat such that the storage member does not appreciably move relative to the seat. Reducing movement of the storage member relative to the seat allows the storage member to stay secured to the seat even if the user stands up, and further accommodates stadium chair type seats to be flipped up to the upright position without interference from the device. In addition, reducing movement enhances the user's ability to access or replace items in the storage member and further provides for easy usage of closure devices such as zippers and hook and loop fasteners. That is, it is easier to access items in and use closure device on a stationary device rather than one that is movable.

In another embodiment, the padded member is interconnected adjacent the first end portion (e.g., the top portion), and the mechanism for suspending comprises a connecting member for interconnecting the padded member adjacent the second end portion (e.g., the bottom portion). For example, the connecting member may include a first securing mechanism (e.g., a hook and loop fastening device) for securing the connecting member to a front surface of the storage member to facilitate wrapping of the device around a seat. Preferably, the mechanism for suspending comprises a mechanism for accommodating a range of seat dimensions (e.g., a longitudinally extending securing mechanism). In addition, the connecting member may further include a second securing mechanism (e.g., a hook and loop fastening device) for securing the connecting member to a back surface of the storage member to facilitate folding of the device for transport.

The storage member preferably includes a storage compartment including at least two opposing walls and a gusset for limiting separation of the two walls, thereby limiting sagging of the storage compartment when horizontally positioned. For example, the gusset may be positioned between mid-portions of the two walls. In order to accommodate long articles, the gusset preferably does not extend all the way to the bottom portion of the storage member. That is, a space exists between the gusset and the bottom portion to allow lateral storage of long articles.

The storage member may also include at least one pouch having an open end, and a securing member (e.g., a hook and loop fastening device) for allowing selective opening and closing of at least a portion of the open end. For example, the pouch may include a gripping tab member for facilitating opening of the open end of the pouch.

In another aspect of the present invention, a method for suspending an article storage device from a seat is provided. The article storage device includes a padded member and a storage member having first and second opposing end portions. The method generally includes the steps of positioning the padded member on a top surface of the seat, and suspending the storage member directly underneath the seat.

Preferably, the step of suspending comprises the step of positioning the storage member substantially horizontally adjacent a bottom surface of the seat.

In one embodiment, the padded member is interconnected with the first end portion and the step of suspending includes the step of interconnecting the padded member with the second end portion. In addition, the device may further include a connecting member interconnected with the padded member, and the step of interconnecting may include the step of attaching the connecting member to a front surface of the storage member. Preferably, the step of interconnecting further includes, before the step of attaching, the step of pulling the connecting member relative to the storage member to thereby tighten the device around the seat.

In another aspect, the present invention provides a method for assembling an article storage device. The method generally includes the steps of forming a storage member having top and bottom portions and front and rear walls, positioning a gusset between the front and rear walls to limit separation of the front and rear walls, inserting a square pad into a pad compartment to form a padded member interconnected with one of said top and bottom portions, interconnecting a connecting member with said padded member, and attaching a securing mechanism to said device to facilitate securing of said connecting member to said storage member. By providing a square pad, the pad can be inserted into the pad compartment at any appropriate orientation, rather than having to align the pad first. Such a feature facilitates assembly of the device.

DETAILED DESCRIPTION

Figure 1:
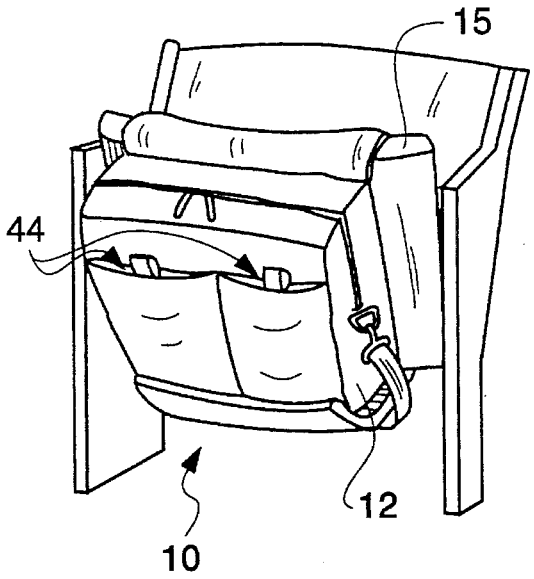
FIG. 1 is a perspective view of one embodiment of the present invention with the device secured to a seat.

One embodiment of the present invention is illustrated in FIGS. 1–8. The illustrated device 10 is a combination seat cushion and article storage device 10 including a storage member 12 for allowing storage of articles, a padded member 14 for providing cushioned support to a top surface of a seat 15, and a connecting member 16 for providing detachable interconnection between the padded member 14 and the storage member 12. The illustrated embodiment provides a device 10 which can be secured to a seat 15 such that the padded member 14 is positioned on a top surface of the seat 15, and the storage member 12 is positioned underneath the seat 15, as will be described below in more detail.

The storage member 12 of the illustrated embodiment comprises a front portion 18, a back portion 20, a top portion 22, a bottom portion 24, and two side portions 26 defining a storage compartment, each made from heavy-duty material, such as 420 NYLON™ pack cloth. The thickness of the storage member 12 preferably ranges from 3 inches to 7 inches, and more preferably is about 5 inches. Access to the storage compartment is provided by an opening 28 in the top portion 22 of the storage member 12. In the illustrated embodiment, the opening 28 is selectably closable by a zipper 30 which extends the full length of the top portion 22 and part way down the side portions 26 of the storage member 12. Zipper fobs 31 are provided to assist in grabbing and operating the zipper 30, especially for when the user is wearing gloves. Attachment rings 32 are provided on both side portions 26 of the storage member 12 to allow securement of a shoulder strap 34 to the storage member 12 to facilitate transport of the device 10.

Figure 6:
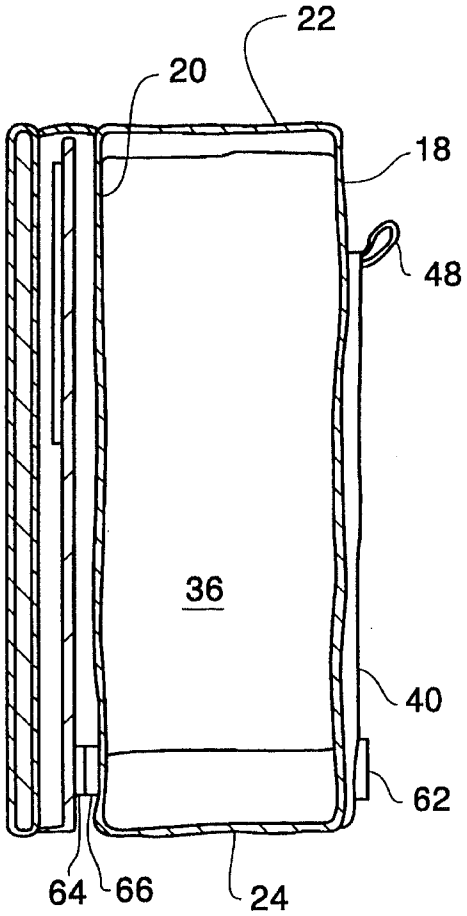
FIG. 6 is a section view taken along line 6—6 in FIG. 5.
Figure 5:
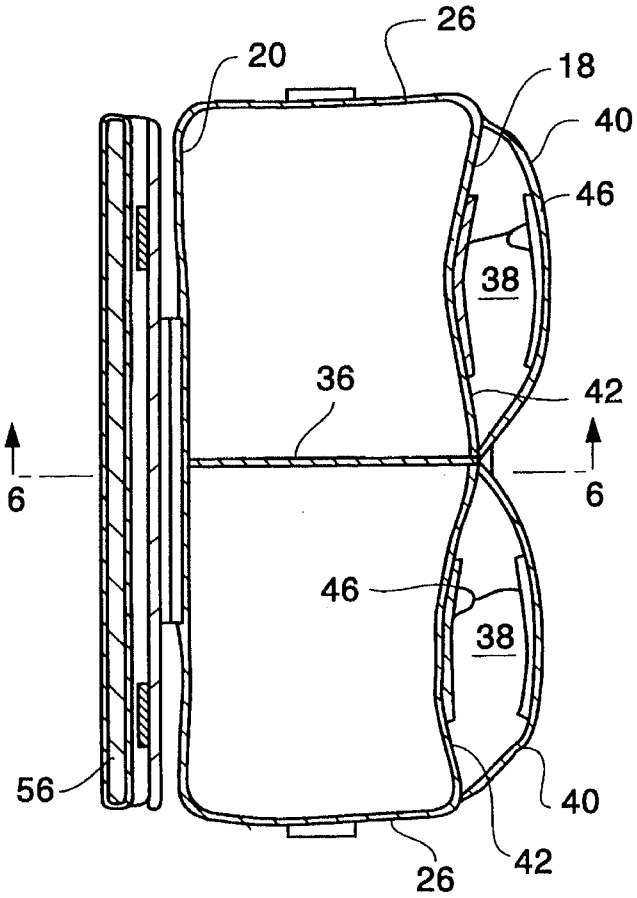
FIG. 5 is a section view taken along line 5—5 in FIG. 2.

Referring specifically to FIGS. 5 and 6, a gusset 36 is positioned within the storage compartment for interconnecting the front portion 18 of the storage member 12 to the back portion 20 of the storage member 12. Such positioning of the gusset 36 limits the separation of the front portion 18 from the back portion 20, thereby limiting sagging of the storage member 12 when the storage member 12 is secured underneath a seat 15 in a substantially horizontal position. As shown in FIG. 6, the gusset 36 preferably does not extend all the way to the bottom portion 24 of the storage member 12, thereby creating a space between the gusset 36 and the bottom portion 24 to facilitate lateral storage of longitudinally-extending articles therein.

Two pouches 38 are positioned on the front portion 18 of the storage member 12, and are defined by an outer wall 40 and an inner wall 42. In the illustrated embodiment, the inner wall 42 is the front portion 18 of the storage member 12. Each pouch 38 includes an open end on an upper end thereof for facilitating access to the pouch 38. The pouches 38 each further include a closure device 46 for allowing selective closure of the pouch 38. In the illustrated embodiment, the closure device 46 includes a hook and loop fastener. To facilitate opening of the pouches 38 (i.e., separation of the hook and loop fasteners), each pouch 38 further includes a tab member 48 secured to the outer wall 40 of each pouch 38. Opening of a pouch 38 is accomplished by pulling the tab member 48 relative to the front portion 18 of the storage compartment until the hook and loop fastener is completely separated. In the illustrated embodiment, the tab member 48 comprises a loop of nylon material.

The padded member 14 of the illustrated embodiment includes a first end 50 which is interconnected to the storage member 12 near the intersection of the top portion 22 and the back portion 20 thereof. The interconnection is accomplished utilizing flexible nylon material and, accordingly, the padded member 14 is moveable (i.e., foldable) relative to the storage member 12. The padded member 14 includes a front side 52 and a back side 54, each made from heavy-duty material, such as 420 NYLON™ pack cloth. Such material was chosen because it is durable, is washable, is water resistant, provides the user with a warm, clean and dry seating surface, and also readily accepts print transfers for graphics (e.g., team logos).

The front side 52 and back side 54 form a cavity within which a pad 56 is positioned. The thickness of the pad 56 can be varied to create a more firm or a more cushioned seating surface. In the illustrated embodiment, the pad 56 is made from EVA (i.e., ethylene-vinyl acetate) foam having a thickness between about ¼ inch and about 1½ inches, and preferably a thickness of about ⅝ inch. EVA foam is used because it does not absorb significant amounts of water and further is not significantly thermally conductive. The pad is preferably square to allow it to be inserted into the device at any appropriate orientation, thereby simplifying assembly, and to universally fit most types of stadium seats. The pad of the illustrated embodiment has been designed to accommodate standard stadium seats having widths of 17 inches, 19 inches, and 21 inches. The pad is also designed to fit on many folding chairs. In the illustrated embodiment, the pad 56 is 13.5 inches wide and 13.5 inches long. Additionally, the padded member 14 provides an excellent surface for visual displays such as athletic team logos.

The connecting member 16 of the illustrated embodiment is secured to a second end 58 of the padded member 14. The connecting member 16 is made from two layers of heavy-duty material, such as 420 NYLON™ pack cloth, and has dimensions of about 13.5 inches wide×13.5 inches long. The connecting member 16 has a tapered end 59 to facilitate insertion of the connecting member 16 behind a seat 15, as described below in more detail.

In order to provide for securement of the device 10 to a seat 15, the device 10 further includes a mechanism for securing the connecting member 16 to the storage member 12 such that the connecting member 16 may be wrapped around the seat 15 and interconnected with the storage member 12, thereby suspending the storage member 12 underneath the seat 15. In the illustrated embodiment, the securing mechanism includes a hook and loop fastener with the hook portion 60 secured to the back of the connecting member 16 and the loop portion 62 secured to the front portion 18 of the storage member 12. Securement to the front portion 18 of the storage member 12 is preferred since it effectively puts the securing mechanism under shear forces, rather than tensile forces, thereby improving the securement. However, it should be appreciated that other positions of the securing mechanism can also be used.

In order to accommodate securement of the device 10 to varying seat dimensions, the hook portion 60 is longitudinally-extending (i.e., about 7 inches long) in alignment with the length of the device 10. That is, the hook portion 60 is significantly longer in the length direction than is required for adequate securement, thereby allowing the loop portion 62 to be secured to the hook portion 60 at different locations to accommodate different seat dimensions. Such a design also allows the storage member to be positioned at varying orientations (e.g., angles) relative to the seat.

Figure 2:
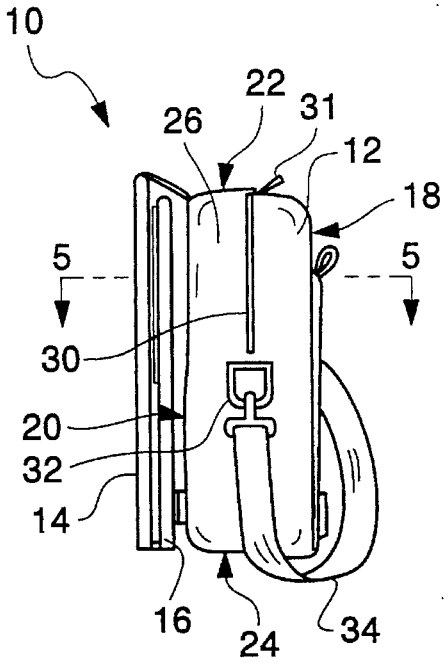
FIG. 2 is a side view of the device shown in FIG. 1 with the device in the folded position for transport.
Figure 3:
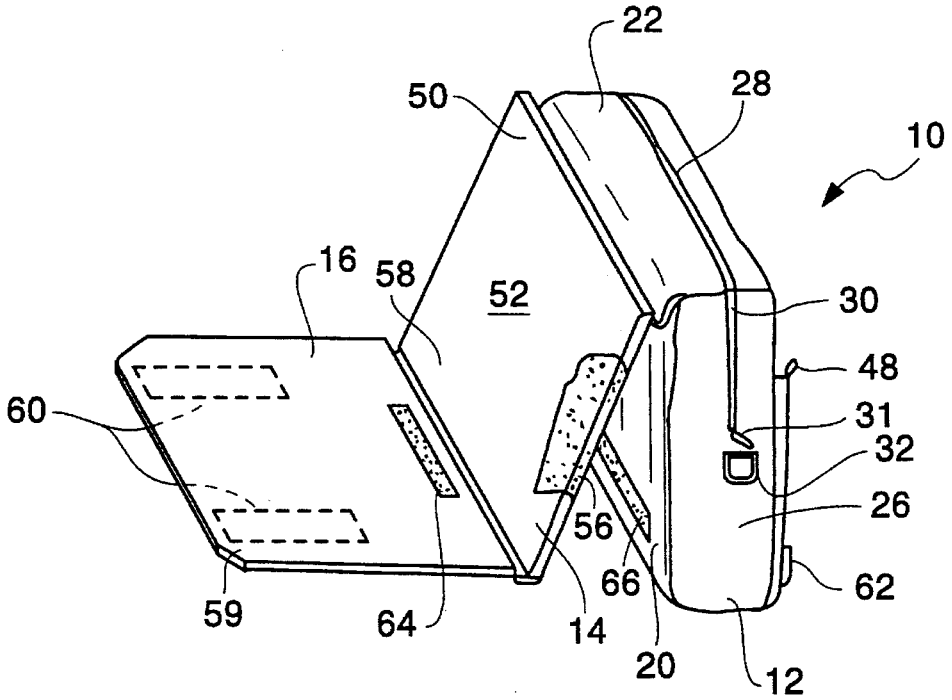
FIG. 3 is a perspective view of the device shown in FIG. 1 with the device partially unfolded.
Figure 4:
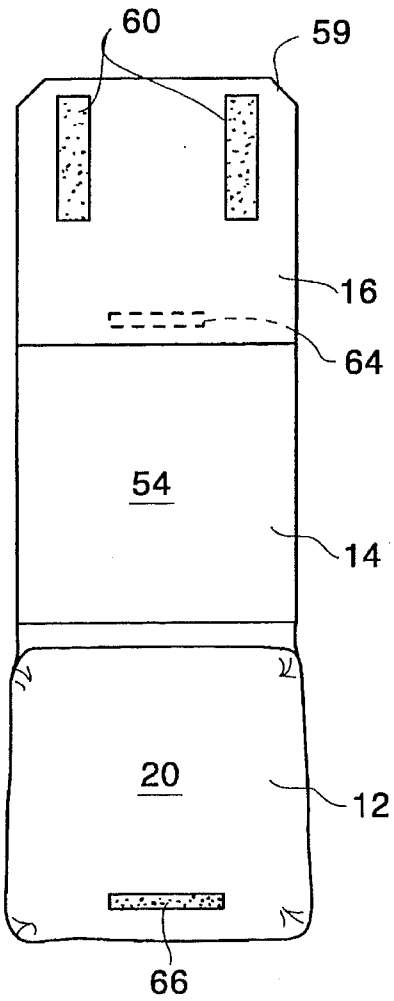
FIG. 4 is a back view of the device shown in FIG. 1 in a completely unfolded condition.

In order to maintain the device 10 in a folded position, as illustrated in FIGS. 2 and 6, a mechanism is provided for detachably securing the front of the connecting member 16 to the back portion 20 of the storage member 12. In the illustrated embodiment, such securing mechanism includes a hook and loop fastener having a loop fastener 64 secured to the front of the connecting member 16 and a hook fastener 66 secured to the back portion 20 of the storage member 12. Such a securing mechanism allows the connecting member 16 to be folded between the padded member 14 and the storage member 12.

Figure 7:
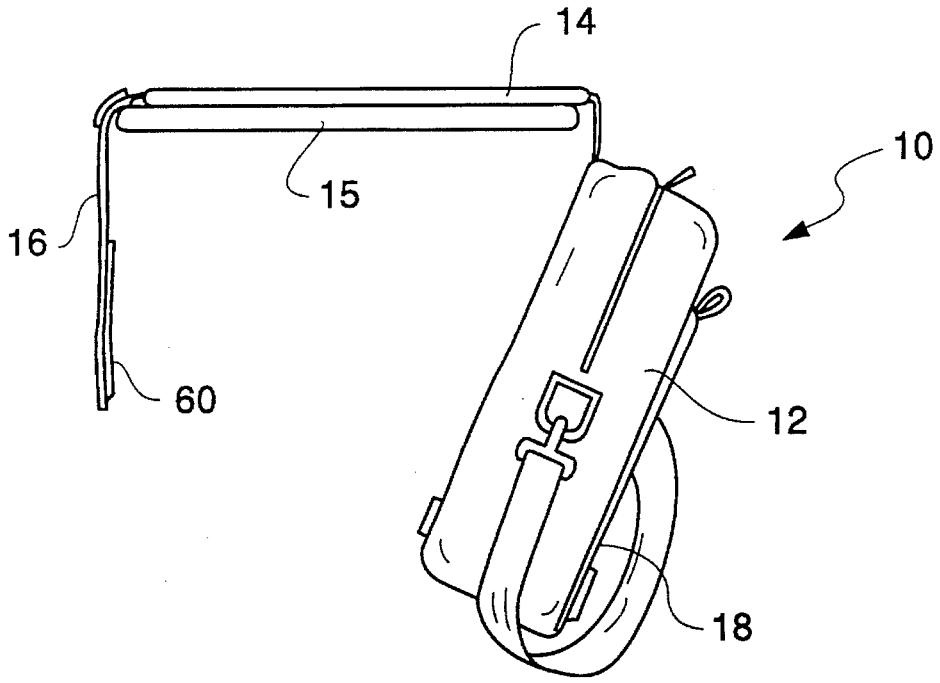
FIG. 7 is a side view of the device shown in FIG. 1 prior to securing the device to the seat.
Figure 8:
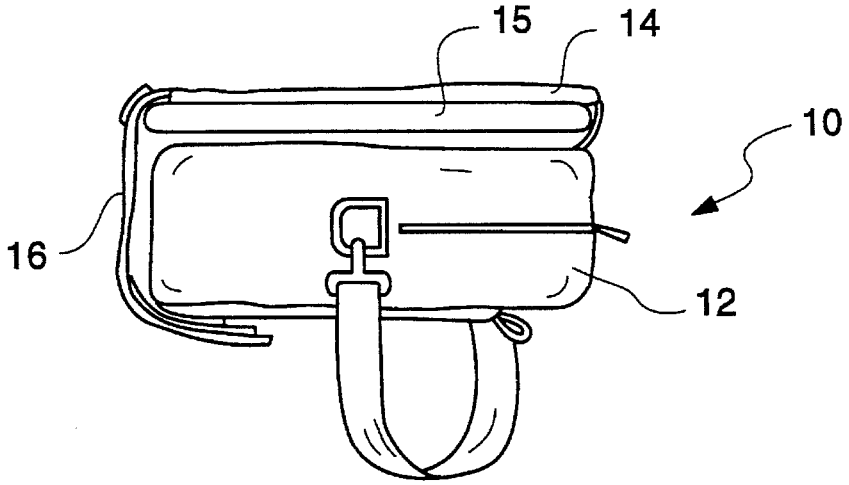
FIG. 8 is a side view of the device shown in FIG. 7 after securing the device to the seat.

In use, the device 10 is transported to an event in the above-described folded position, as illustrated in FIG. 2. Upon arrival at the event, the device 10 is unfolded by detaching the front of the connecting member 16 from the back portion 20 of the storage member 12. The padded member 14 is then placed on a top surface of the seat 15, the storage member 12 is allowed to hang in front of the seat 15, and the connecting member 16 is allowed to hang in back of the seat 15, as illustrated in FIG. 7. It should be noted that there is no need to push or force the connecting member 16 down behind the seat, but rather the connecting member 16 is simply allowed to drop down. The connecting member 16 is then pulled underneath the seat 15 toward the storage member 12, and the storage member 12 is pulled underneath the seat 15 toward the connecting member 16. The back of the connecting member 16 is subsequently secured to the front portion 18 of the storage member 12 to position the storage member 12 in the desired position, as shown in FIG. 8. It should be appreciated that the storage member 12 could be substantially horizontally positioned or at some other desired position, as long as it is underneath the seat 15. By virtue of the longitudinally-extending hook portion 60 on the back of the connecting member 16, the device 10 is able to accommodate varying seat dimensions and/or varying desired positions of the storage member 12, as described above in more detail.

With the storage member 12 positioned underneath the seat 15 as described, it will not interfere with freedom of movement of the user's legs or interfere with people walking in front of the seat 15. Furthermore, the storage member 12 will stay secured to the seat 15 even if the user stands up. In addition, articles within the storage compartment and pouches 38 are readily accessible by the user through the openings 28 in the top portion 22 of the storage member 12 and pouches 38.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A seat storage device comprising:

a) a first member for placement on top of a seat;

b) a connecting member operatively interconnected with a front portion of said first member and designed to be placed in front of a front edge of said seat;

c) a storage member designed for horizontal placement below a bottom of said seat wherein a top portion of said storage member is operatively interconnected with said connecting member; and d) a releasable rear connecting member designed to be placed behind a back edge of said seat and designed to interconnect a rear portion of said first member with said storage member to form a closed loop around at least portions of the top, rear edge, bottom, and front edge of said seat, wherein said rear connecting member has means for releasably connecting with said storage member including hook and loop fabric fastener devices secured directly to a back of the releasable rear connecting member and to a front portion of the storage member in such a manner as to allow the storage device to accommodate various seat lengths.

2. The storage device of claim 1 wherein said storage device is constructed from NYLON pack cloth.

3. A seat storage device comprising:

a) a first member for placement on top of a seat;

b) a connecting member operatively interconnected with a front portion of said first member and designed to be placed in front of a front edge of said seat;

c) a storage member designed for horizontal placement below a bottom of said seat wherein a top portion of said storage member is operatively interconnected with said connecting member; and d) a releasable rear connecting member designed to be placed behind a back edge of said seat and designed to interconnect a rear portion of said first member with said storage member to form a closed loop around at least portions of the top, rear edge, bottom, and front edge of said seat, wherein said rear connecting member and said storage member have hook and loop fastener devices directly secured to a front of said rear connecting member and to a back portion of said storage member in order to allow said rear connecting member to be folded between the first member and storage member to facilitate easy compact transport of said storage device when not attached to said seat.

4. The storage device of claim 3 wherein said storage device is constructed from NYLON pack cloth.

5. The storage device of claim 3 wherein said rear connecting member is designed to be releasably connectable with said storage member through the use of said hook and loop fastener devices.

6. An article storage device comprising:

a) a storage member having first and second opposing end portions;

b) a padded member interconnected with said storage member; and c) a means for suspending said storage member directly underneath a seat, wherein said article storage device is capable of attachment to said seat such that said means for suspending, said padded member and said storage member form a closed loop encircling at least portions of: (i) a top of the seat lengthwise from front to back; (ii) a rear edge of the seat; (iii) a bottom of the seat lengthwise from back to front; and (iv) a front edge of the seat, wherein said storage member comprises a storage compartment including at least two opposing walls, a gusset for limiting separation of said two walls and a bottom portion, and wherein a space exists between said gusset and said bottom portion.

7. The storage device of claim 6 wherein said storage device is constructed from NYLON pack cloth.

8. An article storage device, as claimed in claim 6, further comprising a shoulder strap for looping around a person's shoulder to facilitate carrying of the device.

9. An article storage device, as claimed in claim 6, wherein said gusset is positioned between mid-portions of said two walls.

10. An article storage device, as claimed in claim 6, wherein said means for suspending comprises a means for accommodating a range of seat dimensions.

11. An article storage device, as claimed in claim 6, wherein said means for suspending comprises means for positioning said storage member substantially horizontally adjacent a bottom surface of the seat.

12. An article storage device, as claimed in claim 6, wherein said storage member comprises:

at least one pouch having an open end; and a securing member for allowing selective opening and closing of at least a portion of said open end.

13. An article storage device, as claimed in claim 12, wherein said pouch further includes a gripping tab for facilitating opening of said open end of said pouch.

14. An article storage device, as claimed in claim 6, wherein said padded member is interconnected with the first end portion, and wherein said means for suspending comprises a connecting member for interconnecting said padded member with said second end portion.

15. An article storage device, as claimed in claim 14, wherein said connecting member comprises a first securing means for securing said connecting member to a front surface of said storage member.

16. An article storage device, as claimed in claim 15, wherein said connecting member further comprises a second securing means for securing said connecting member to a back surface of said storage member.

* * * * *